US006464344B2

(12) United States Patent
Ikeda

(10) Patent No.: US 6,464,344 B2
(45) Date of Patent: Oct. 15, 2002

(54) MICROSTRUCTURED ELEMENT AND METHOD FOR PRODUCING THE SAME

(75) Inventor: Tomoo Ikeda, Tokorozawa (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/748,167

(22) Filed: Dec. 27, 2000

(65) Prior Publication Data

US 2002/0113844 A1 Aug. 22, 2002

(51) Int. Cl.[7] ..... B41J 2/05; B41J 2/17
(52) U.S. Cl. ..... 347/65; 347/94
(58) Field of Search ..... 347/20, 65, 67, 347/93, 94, 56, 63

(56) References Cited

U.S. PATENT DOCUMENTS 4,897,674 A * 1/1990 Hirasawa ..... 347/65

FOREIGN PATENT DOCUMENTS

JP 2000-03030 * 1/2000 ..... G03F/7/00
JP 2000-71446 3/2000 ..... B41S/2/045
JP 2000-87862 * 3/2000 ..... F04B/43/04

* cited by examiner

*Primary Examiner*—Thinh Nguyen
*Assistant Examiner*—Juanita Stephens
(74) *Attorney, Agent, or Firm*—Finnegan, Henderson, Farabow, Garrett & Dunner, L.L.P.

(57) ABSTRACT

A microstructured element comprising a transparent substrate-having a major surface; an opaque layer formed in a certain pattern on the major surface of the transparent substrate; and a microstructured layer formed on or above the major surface of the transparent substrate in a pattern corresponding to the certain pattern of the opaque layer. The microstructured layer includes a slanted lateral face extending along an edge of the opaque layer in a direction intersecting the major surface at an oblique angle. The microstructured element is produced through the steps of providing a photosensitive layer entirely on the major surface of the transparent substrate and the opaque layer; exposing the photosensitive layer to light transmitted through the transparent substrate from a back surface opposite to the major surface at an oblique angle with the major surface; and developing the photosensitive layer.

13 Claims, 15 Drawing Sheets

MICROSTRUCTURED ELEMENT AND METHOD FOR PRODUCING THE SAME

BACKGROUND OF THE INVENTION

1. Field of the Invention

The present invention relates to a microstructured element. The present invention also relates to a method for producing a microstructured element.

2. Description of the Related Art

Various types of structural minute elements have been used in miniature or precision equipment for various physical purposes. For example, in the technical field of printing machines, a print or ink-jet head incorporated in an ink jet printer or plotter is known as one example of miniature or precision equipment including minute elements. A thermal-type print head of a conventional ink jet printer or plotter generally includes a body with a plurality of channels or grooves, a base secured to the body so as to cover the length of the grooves, a plurality of heating elements arranged on a surface of the base facing toward the body, and a nozzle plate fixed to the body adjacent to the longitudinal ends of the grooves. The body, the base and the nozzle plate are structural minute elements for affecting the flow of ink by the shape or dimension of an ink passage defined in these components, as described below.

A plurality of pressurizing chambers are defined between the grooves of the body, the base and the nozzle plate. The pressurizing chambers are connected to a flow-dividing chamber provided in the body, and ink supplied from an external ink-source flows through the flow-dividing chamber into the respective pressurizing chambers. The nozzle plate is provided with a plurality of nozzles, each of which opens to the respective one of the pressurizing chambers. Each of the heating elements is located at a position corresponding to the respective one pressurizing chamber. The heating element is energized to instantaneously heat the ink held in the corresponding pressurizing chamber, so that the ink is pressurized due to the thermal expansion thereof and thereby discharged through the nozzle aligned to the pressurizing chamber.

In this structure, when the ink held in each pressurizing chamber is pressurized by the energization of the corresponding heating element, some of the ink may flow back to the flow-dividing chamber. Accordingly, in the conventional, thermal-type ink jet printer or plotter, it is required to reduce the back flow of the ink from the pressurizing chambers, by optimizing the dimensions of the pressurized chambers and the nozzles as well as the positions of the heating elements, in order to obtain a sufficient pressure or discharging energy of the ink. The lack of ink discharging energy can make the discharged ink susceptible to an external force, and thereby the ink-discharging performance as well as the printing quality of the ink jet printer may be deteriorated. Further, the back flow of the ink from the pressurizing chambers may deteriorate the response of the ink discharging operation of the print head.

On the other hand, a piezoelectric-type print head of a conventional ink jet printer or plotter generally includes a body with a plurality of channels or grooves, a diaphragm secured to the body so as to cover the length of the grooves, a plurality of piezoelectric elements arranged on the reverse side of the diaphragm away from the grooves, and a nozzle plate fixed to the body adjacent to the longitudinal ends of the grooves. The body, the diaphragm and the nozzle plate are structural minute elements for affecting the flow of ink by the shape or dimension of an ink passage defined in these components, as described below.

The diaphragm is made of a flexible material, and a plurality of pressurizing chambers are defined between the diaphragm, the grooves of the body and the nozzle plate. The pressurizing chambers are connected to a flow-dividing chamber provided in the body, and ink supplied from an external ink-source flows through the flow-dividing chamber into the respective pressurizing chambers. The nozzle plate is provided with a plurality of nozzles, each of which opens to the respective one of the pressurizing chambers. Each of the piezoelectric elements is located at a position corresponding to the respective one pressurizing chamber along the reverse side of the diaphragm.

The piezoelectric element is excited to generate an electrostrictive effect, and thereby actuates or deforms a part of the diaphragm defining the corresponding one of the pressurizing chambers. As the part of the diaphragm is deformed to instantaneously reduce the volume of the corresponding pressurizing chamber, the ink held therein is pressurized and thereby discharged through the nozzle aligned to the pressurizing chamber. The piezoelectric elements are separated from each other and are fixedly supported on a base that, in turn, is securely assembled with the body, so as to eliminate any influence on the other parts of the diaphragm defining the other pressurizing chambers during an ink pressurizing operation.

The pressurizing chambers are normally connected to the flow-dividing chamber through restrictions or orifices provided also in the body. When the ink held in each pressurizing chamber is pressurized by the excitation of the corresponding piezoelectric element, the ink is substantially prevented from flowing back to the flow-dividing chamber due to large fluid resistance at the orifice, and thereby is discharged with a sufficient pressure through the nozzle.

The restrictions or orifices are designed and dimensioned to suitably control the ink flow inside the print head, so as to optimize the ink-discharging performance of the ink jet printer. In this respect, when the cross-sectional area of the restriction or orifice is further reduced and the fluid resistance thereof is further increased, the larger discharging energy of the ink from the pressurizing chamber through the nozzle is obtained. The increased discharging energy of the ink can make it hard for the discharged ink to be affected by an external force and, therefore, the ink-discharging performance as well as the printing quality of the ink jet printer can be improved.

However, the reduction of the cross-sectional area of the restriction or orifice also makes it difficult for the ink to flow from the flow-dividing chamber to the respective pressurizing chamber. As a result, ink may be insufficiently supplied into the respective pressurizing chambers or, otherwise, the time required for sufficiently supplying ink into each pressurizing chamber after the ink is discharged therefrom through the nozzle may be increased, which may deteriorate the response of the ink discharging operation of the print head. Accordingly, it is difficult for the conventional, piezoelectric-type ink jet printer or plotter to ensure both a high printing quality and a quick discharge response.

As another example of miniature or precision equipment including minute elements, in the field of hydro-pneumatic arts, a miniaturized pump unit for ensuring a high precision control of a fluid flow rate, used for, e.g., chemical-analysis or medical purposes, is known. A valveless-type, conventional miniaturized pump unit generally includes a body with a fluid-passage or channel, a diaphragm secured to the body so as to cover the length of the channel, and a plurality of piezoelectric elements arranged on the reverse side of the diaphragm away from the channel in a longitudinal array along the length of the channel. The body is a structural minute element for affecting the flow of fluid by the shape or dimension of a fluid passage defined in the body, as described below.

The channel of the body includes a plurality of expanded areas located in mutually spaced arrangement along the length of the channel. The diaphragm is made of a flexible material, and a plurality of pressure chambers are defined between the diaphragm and the expanded areas of the channel of the body. The channel opens the opposite sides of the body and is connected at respective open ends with an external fluid circuit. Each of the piezoelectric elements is located at a position corresponding to the respective one pressure chamber along the reverse side of the diaphragm.

The piezoelectric element is excited to generate an electrostrictive effect, and thereby actuates or deforms a part of the diaphragm defining the corresponding one of the pressure chambers. As the pair of adjacent parts of the diaphragm are deformed to subsequently reduce and thereafter subsequently increase in the same order the volumes of the corresponding pressure chambers, the fluid in the external fluid circuit is pumped through the channel from one open end thereof to the other in a direction corresponding to the propagating direction of the deformation of the diaphragm parts.

The conventional miniaturized pump unit is properly operated by suitably controlling the sequential deformation of the adjacent parts of the diaphragm. To this end, it is necessary to excite the piezoelectric elements while maintaining an accurate predetermined phase-difference therebetween, which may complicate the control system of the miniaturized pump unit. Also, a plurality of pressure chambers and a plurality of piezoelectric elements are inevitably used, whereby it may be difficult to reduce the dimension of the miniaturized pump unit, as well as the manufacturing cost thereof, to a required level.

Incidentally, there have been certain cases wherein the structural minute elements, such as the body of the print head or of the miniaturized pump, are cut or machined by suitable machine tools, so as to impart desired shapes and dimensions to the minute elements. In this case, it is generally necessary to spend much time in a machining process, to ensure the high accuracy of machining of the minute element, which may reduce the production of the minute element. It is also required to provide a cutting tool with a significant dimensional accuracy and a high mechanical strength, which may increase the manufacturing cost of miniature or precision equipment including the minute element.

SUMMARY OF THE INVENTION

It is therefore an object of the present invention to provide a minute element with a high dimensional accuracy, adapted to be incorporated in miniature or precision equipment.

Another object of the present invention is to provide a method of producing a minute element with a high dimensional accuracy, without using a machining process.

Further object of the present invention is to provide an ink-jet head including a minute element, which can ensure high printing quality as well as a quick discharge response when incorporated in an ink jet printer or plotter.

Yet another object of the present invention is to provide a miniaturized pump unit, including a minute element, which can be easily and properly operated with a relatively simple structure, and can facilitate the reduction of dimensions and manufacturing cost to a required level.

Yet further object of the present invention is to provide a method of producing such an ink-jet head or a miniaturized pump unit.

In order to accomplish the above objects, the present invention provides a microstructured element comprising a transparent substrate having a major surface; an opaque layer formed in a certain pattern on the major surface of the transparent substrate; and a microstructured layer formed on or above the major surface of the transparent substrate in a pattern corresponding to the certain pattern of the opaque layer, the microstructured layer including a slanted lateral face extending along an edge of the opaque layer in a direction intersecting the major surface at an oblique angle.

In this microstructured element, the microstructured layer may be made of a photosensitive material.

Also, the microstructured layer may be formed directly on the major surface of the transparent substrate.

Alternatively, the microstructured layer may be formed directly on the opaque layer.

It is preferred that the opaque layer comprises a plurality of opaque strips, and that the microstructured layer comprises a plurality of oblique ribs projecting obliquely from the transparent substrate.

The present invention also provides a method for producing a microstructured element, comprising providing a transparent substrate having a major surface; forming an opaque layer in a certain pattern on the major surface of the transparent substrate; and forming a microstructured layer on or above the major surface of the transparent substrate in a pattern corresponding to the certain pattern of the opaque layer, the microstructured layer being provided with a slanted lateral face extending along an edge of the opaque layer in a direction intersecting the major surface at an oblique angle.

In this method, it is advantageous that forming the microstructured layer on or above the major surface of the transparent substrate includes providing a photosensitive layer entirely on the major surface of the transparent substrate and the opaque layer; exposing the photosensitive layer to light transmitted through the transparent substrate from a back surface opposite. to the major surface at an oblique angle with the major surface; and developing the photosensitive layer.

In this arrangement, developing the photosensitive layer may include dissolving a part of the photosensitive layer, which is not exposed to light in the exposing step, by a developer.

Also, forming the microstructured layer further may include plating the opaque layer to fill a recess formed by developing the photosensitive layer with a plating metal; and removing the photosensitive layer while keeping the plating metal laying above the major surface of the transparent substrate.

The present invention further provides an ink-jet head comprising a body; an ink passage defined in the body, the ink passage including a pressurizing chamber for holding ink; an actuator arranged in association with the pressurizing chamber, the actuator capable of being energized to pressurize the ink held in the pressurizing chamber; a nozzle opening to the pressurizing chamber; and an oblique rib protruding inside the ink passage to lean toward the nozzle.

In this ink-jet head, it is advantageous that the ink-jet head further comprises a microstructured element assembled with the body, the microstructured element including a transparent substrate having a major surface; an opaque layer formed in a certain pattern on the major surface of the transparent substrate; and a microstructured layer formed on or above the major surface of the transparent substrate in a pattern corresponding to the certain pattern of the opaque layer, the microstructured layer including a slanted lateral face extending along an edge of the opaque layer in a direction intersecting the major surface at an oblique angle; and that the microstructured layer comprises the oblique rib projecting obliquely from the transparent substrate.

The oblique rib may protrude inside the pressurizing chamber.

Alternatively, the ink passage may include a plurality of pressurizing chambers and a flow-dividing chamber connected to the pressurizing chambers, and the oblique rib may protrude inside the flow-dividing chamber.

It is preferred that a plurality of oblique ribs are disposed in a mutually parallel side-by-side arrangement in the ink passage.

The present invention yet further provides a miniaturized pump unit comprising a body; a fluid passage defined in the body, the fluid passage including a pressure chamber and inlet and outlet ports connected to the pressure chamber; an actuator arranged in association with the pressure chamber, the actuator capable of being energized to pressurize the fluid in the pressure chamber; a first oblique rib protruding inside the inlet port to lean toward the pressure chamber; and a second oblique rib protruding inside the outlet port to lean toward an open end of the outlet port.

In this miniaturized pump unit, it is advantageous that the miniaturized pump unit further comprises a microstructured element assembled with the body, the microstructured element including a transparent substrate having a major surface; an opaque layer formed in a certain pattern on the major surface of the transparent substrate; and a microstructured layer formed on or above the major surface of the transparent substrate in a pattern corresponding to the certain pattern of the opaque layer, the microstructured layer including a slanted lateral face extending along an edge of the opaque layer in a direction intersecting the major surface at an oblique angle; and that the microstructured layer comprises the first and second oblique ribs projecting obliquely from the transparent substrate.

It is preferred that a plurality of first oblique ribs are disposed in a mutually parallel side-by-side arrangement in the inlet port, and that a plurality of second oblique ribs are disposed in a mutually parallel side-by-side arrangement in the outlet port.

BRIEF DESCRIPTION OF THE DRAWINGS

The above and other objects, features and advantages of the present invention will become more apparent from the following description of preferred embodiments in connection with the accompanying drawings, in which.

DESCRIPTION OF THE PREFERRED EMBODIMENTS

Figure 1:
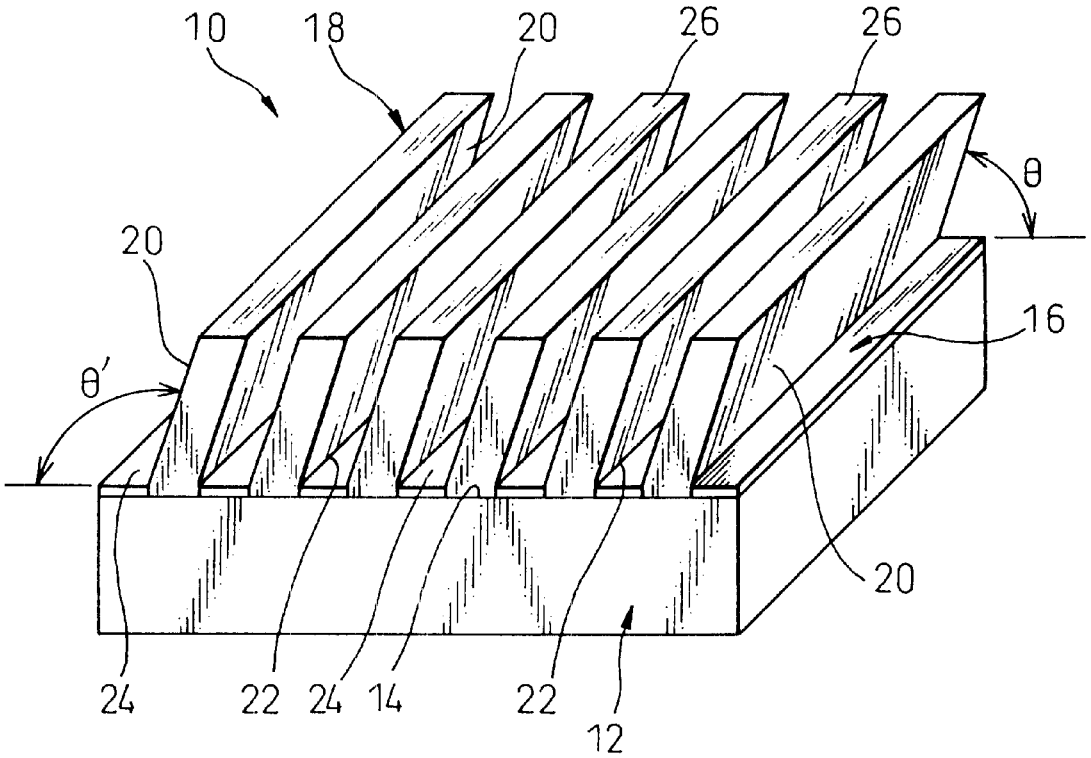
FIG. 1 is a perspective view showing a microstructured element according to one embodiment of the present invention.
Figure 2A:
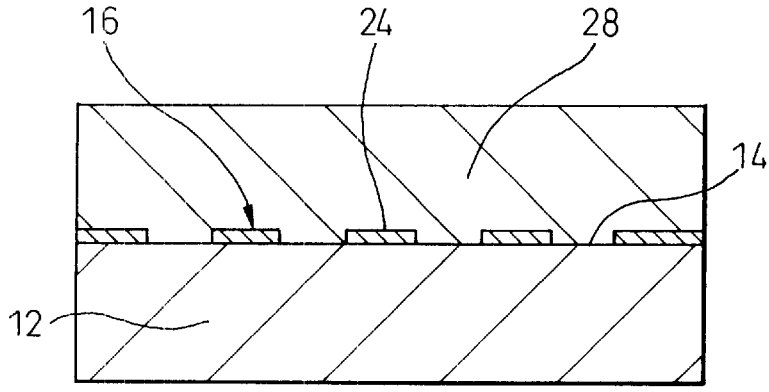
FIGS. 2A to 2C illustrate the steps of manufacturing of the microstructured element shown in FIG. 1.
Figure 2B:
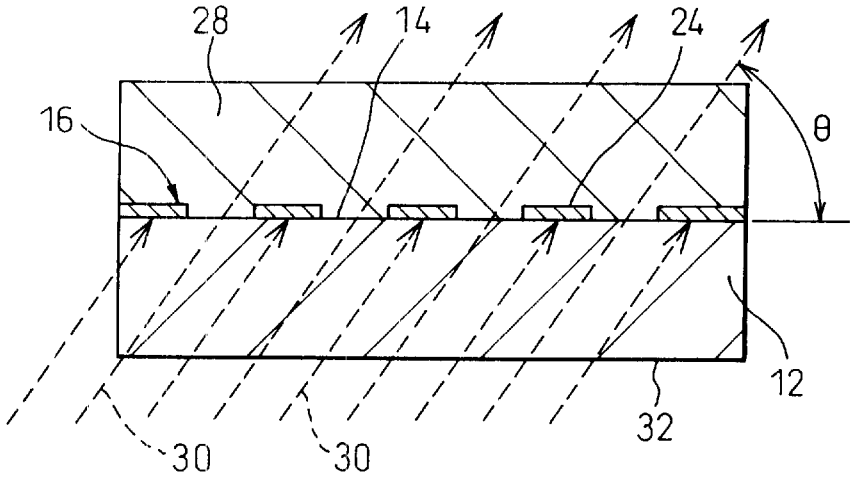
Figure 2C:
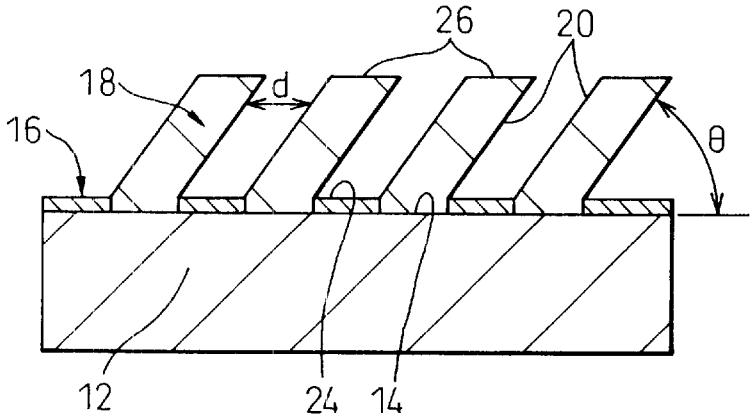

Referring to the drawings, wherein the same or similar components are denoted by common reference numerals, FIG. 1 shows a microstructured element 10 according to one embodiment of the present invention, and FIGS. 2A to 2C show a method of producing the microstructured element 10.

The microstructured element 10 includes a transparent substrate 12 having a generally flat major surface 14, an opaque layer 16 formed in a certain desired pattern on the major surface 14 of the transparent substrate 12 and a microstructured layer 18 formed on or above the major surface 14 of the transparent substrate 12 in a pattern corresponding to the pattern of the opaque layer 16. The microstructured layer 18 is provided with a generally flat, slanted lateral face 20 extending in a direction intersecting the major surface 14 at an oblique angle $\theta$ and along an edge 22 of the opaque layer 16.

In the illustrated embodiment, the opaque layer 16 is formed as a plurality of rectangular opaque strips 24. disposed in a mutually parallel, side-by-side arrangement, i.e., in a streaked pattern, on the major surface 14 of the transparent substrate 12 and securely fixed to the major surface 14. Also, the microstructured layer 18 is formed as a plurality of minute oblique ribs or projections 26, each having a parallelogram vertical section, disposed, in a mutually parallel side-by-side arrangement, on and projecting obliquely from the major surface 14 of the transparent substrate 12 at local surface portions between the opaque strips 16. Therefore, in this embodiment, the microstructured layer 18 as oblique ribs 26 is securely fixed directly to the major surface 14, and plural pairs of slanted lateral faces 20 are provided for the respective oblique ribs 26 so as to extend in parallel to each other. The pair of slanted lateral faces 20 of each rib 26 extend to intersect the major surface 14 at the respective oblique angle $\theta$, $\theta'$ ($=\pi-\theta$).

It should be noted that, in the present invention, the microstructured element may include at least one opaque layer (e.g., having a shape of opaque strips 24 connected with each other) and at least one microstructured element (e.g., having a shape of oblique ribs 26 connected with each other), which have mutually corresponding patterns on the major surface of the transparent substrate.

The microstructured element 10 having the above construction is manufactured through the steps of (I) providing the transparent substrate 12 having the major surface 14; (II) forming the opaque layer 16 in the form of the plural opaque strips 24 on the major surface 14 of the transparent substrate 12 in a parallel streaks pattern; and (III) forming the microstructured layer 18 in the form of the plural oblique ribs 26 on the major surface 14 of the transparent substrate 12 in a pattern corresponding to the streaks pattern of the opaque layer 16

More specifically, the step (III) includes the steps of (i) providing a photosensitive layer 28 entirely on the major surface 14 of the transparent substrate 12 and the opaque layer 16 in the form of the plural opaque strips 24 (FIG. 2A); (ii) exposing the photosensitive layer 28 to light 30 transmitted through the transparent substrate 12 from a back surface 32 opposite to the major surface 14 at an oblique exposing angle θ with the major surface 14 (FIG. 2B); and (iii) developing the photosensitive layer 28 to dissolve a part of the photosensitive layer 28, which is not exposed to light 30 in the exposing step, by a not-shown suitable developer, and thereby forming the microstructured layer 18 in the form of the plural oblique ribs 26 (FIG. 2C). In the exposing step (ii), the opaque layer 16 serves to locally shield the light incident obliquely on the photosensitive layer 28, and thereby to create exposed and unexposed portions in the latter. Thus, in the developing step (iii), the microstructured layer 18 is formed as the plural oblique ribs 26.

Figure 3A:
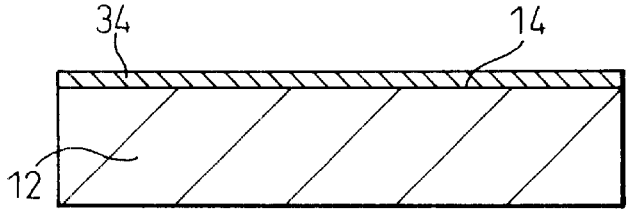
FIG. 3A to 3D illustrate the other steps of manufacturing of the microstructured element shown in FIG. 1.
Figure 3B:
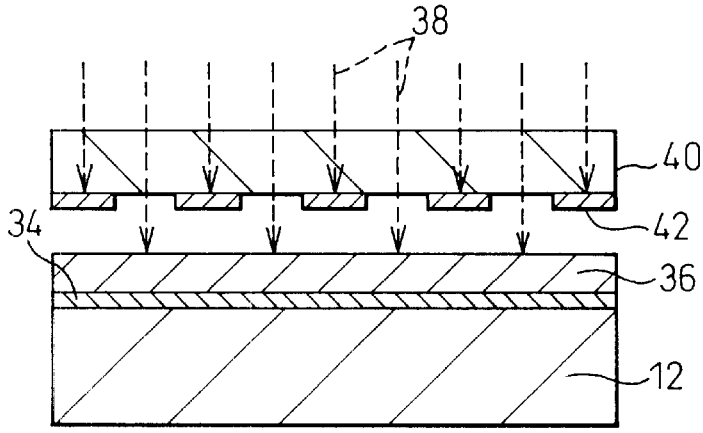
Figure 3C:
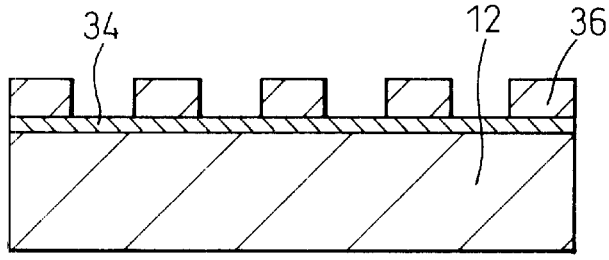
Figure 3D:
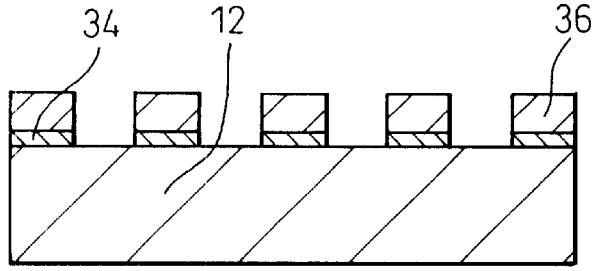

The step (II) may be carried out through a known physical vapor deposition technique and a known lithography technique, as shown in FIGS. 3A to 3D. That is, first an opaque film 34 is formed on the major surface 14 of the transparent substrate 12 by a sputtering process (FIG. 3A). A photosensitive material or positive-type resist 36 is then coated on the opaque film 34, and is exposed to ultraviolet 38 through a mask 40 having a desired pattern of shielding 42 (FIG. 3B). Next, the resist 36 is developed to dissolve a portion thereof exposed to ultraviolet 38 (FIG. 3C). Thereafter, the portion of the opaque film 34 not covered by the resist 36 is etched to pattern the opaque film 34 (FIG. 3D). Finally, the resist 36 is removed, and thereby the opaque layer 16 in the form of the plural opaque strips 24 is formed.

According to the above manufacturing steps, it is possible to form the microstructured layer 18 in various desired patterns and dimensions, by adjusting the pattern and dimension of the opaque layer 16 and by controlling the oblique exposing angle θ of light 30 transmitted through the transparent substrate 12. It is also possible to produce a significantly fine structural element including the microstructured layer 18, while ensuring a high dimensional accuracy considerably superior to a dimensional accuracy expected in a machining process by using any conventional machine tool. Moreover, a desired number of microstructured elements 10 can be simultaneously produced by carrying out the exposing and developing steps to a large-sized blank with a large-sized photosensitive layer 28.

Therefore, according to the invention, it is possible to improve the productivity of the microstructured element 10 and to reduce the manufacturing cost of the latter. The microstructured element 10 having the above construction may advantageously be incorporated in various miniature or precision equipments, such as those described later.

Certain examples of the constitution or configuration of the microstructured element 10 and of the material usable for carrying out the manufacturing process of the microstructured element 10 are as follows. The transparent substrate 12 is made of a glass pane with a thickness of 0.4 mm. The opaque layer 16 is made of a chromium (Cr) film with a thickness of 0.1 μm, which is deposited on the transparent substrate 12 and patterned through a conventional lithography technique into the opaque strips 24 with 40 μm spaces therebetween. The photosensitive layer 28 is made of a negative-type thick film resist (trade name THB-130N; available from JSR Corporation, Tokyo), and is coated on the transparent substrate 12 and the opaque layer 16, to a thickness of 100 μm through a spin-coat technique wherein a coating process at a rotation speed of 1000 rpm for 10 seconds is performed two times. The photosensitive layer 28 is exposed to the light 30 transmitted through the transparent substrate 12 from the back surface 32 at the oblique exposing angle of 60 degrees, at an exposure value of 600 mJ/cm$^2$. The photosensitive layer 28 is then developed by using a developer suitable for THB-130N (trade name THB-D1; available from JSR Corporation, Tokyo) at a temperature of 40° C. for 5 minutes. In this manner, the oblique ribs 26, each being 100 μm in height and having an oblique angle of 60 degrees, are formed as the microstructured layer 18, while 40 μm horizontal spaces "d" (FIG. 2C) are defined between the adjacent ribs 26.

It is preferred that the oblique exposing angle θ is selected in a range from 30 to 85 degrees and from 95 to 150 degrees. If the exposing angle θ is less than 30 degrees or more than 150 degrees, total reflection of light may be caused by the transparent substrate 12. If the exposing angle θ is more than 85 degrees and less than 95 degrees, it may be difficult to precisely form the microstructured layer 18 while ensuring an accurate angle θ of the oblique ribs 26 mainly due to the possible lack of sensitivity of the photosensitive layer 28. It should be noted, however, that the preferred range of the exposing angle θ may vary in accordance with the materials and the other properties of the transparent substrate 12 and of the photosensitive layer 28.

Figure 4:
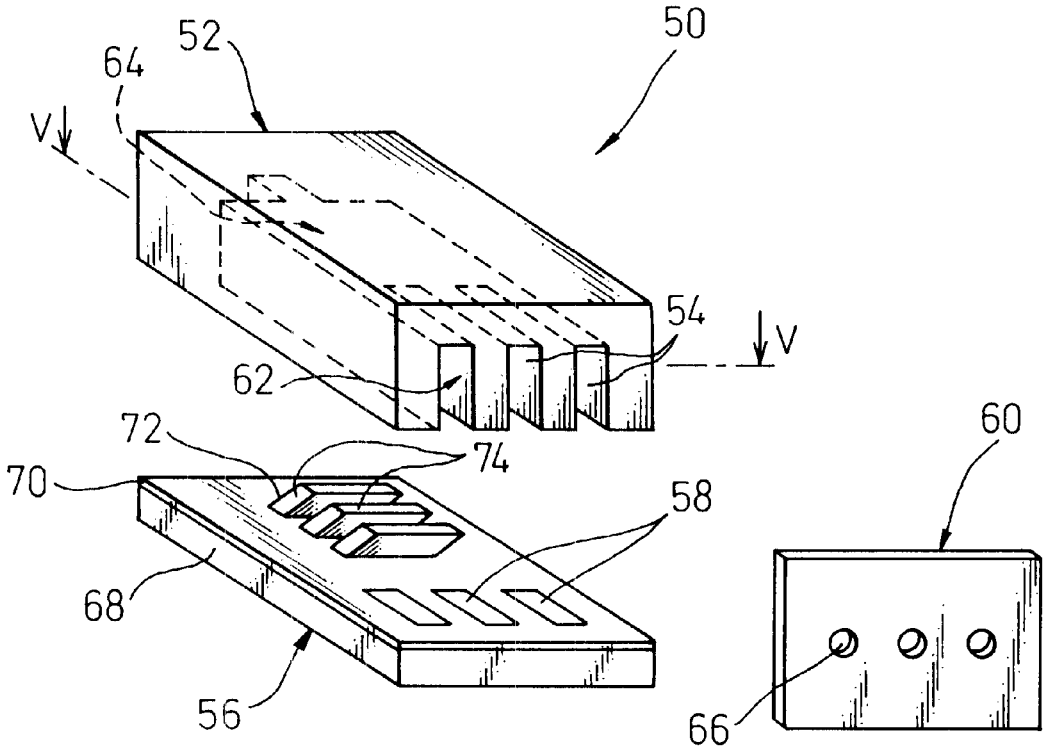
FIG. 4 is an exploded perspective view of an ink-jet head according to another embodiment of the present invention.
Figure 5:
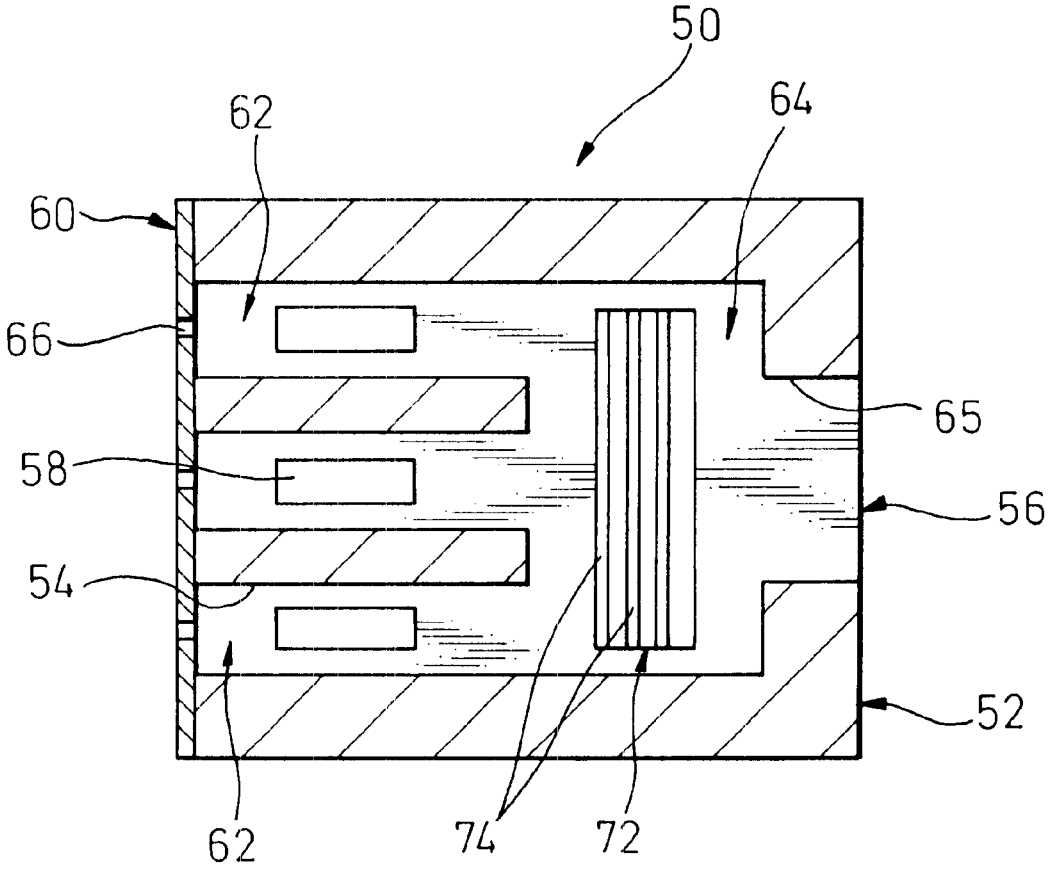
FIG. 5 is a sectional view showing the ink-jet head of FIG. 4, taken along line V—V in an assembled state.

FIGS. 4 and 5 show a thermal-type ink-jet head 50 including a microstructured element, according to one embodiment of the present invention and adapted to be incorporated in an ink jet printer or plotter (not shown). The ink-jet head 50 includes a body 52 with a plurality (three, in the drawing) of channels or grooves 54, a base 56 secured to the body 52 so as to cover the length of the grooves 54, a plurality (three, in the drawing) of heating elements or actuators 58 arranged on a surface of the base 56 facing toward the body 52, and a nozzle plate 60 fixed to the body 52 adjacent to the longitudinal ends of the grooves 54. The body 52, the base 56 and the nozzle plate 60 are structural minute elements for affecting the flow of ink by the shape or dimension of an ink passage defined in these components, and especially, the base 56 comprises a microstructured element, the constitution of which is similar to that of the microstructured element 10 shown in FIG. 1.

A plurality (three, in the drawing) of pressurizing chambers 62 are defined between the grooves 54 of the body 52, the base 56 and the nozzle plate 60. The pressurizing chambers 62 are connected to a flow-dividing chamber 64 defined in the body 52, and ink supplied from an external ink-source (not shown) flows through the flow-dividing chamber 64 into the respective pressurizing chambers 62. In this embodiment, the flow-dividing chamber 64 is defined between a wider groove, recessed in the body 52 adjacent to the grooves 54, and the base 56. Also, the flow-dividing chamber 64 may be connected through an ink inlet 65 defined in the body 52 with an ink conduit (not shown) extending from the external ink-source.

The nozzle plate 60 is provided with a plurality (three, in the drawing) of nozzles 66, each of which opens. to the respective one of the pressurizing chambers 62. Each of the heating elements 58 is arranged in association with the respective one pressurizing chamber 62 and is located at a position corresponding to the latter. The heating element 58 is excited to instantaneously heat the ink held in the corresponding pressurizing chamber 62, so that the ink is pressurized due to the thermal expansion thereof and thereby discharged through the nozzle 66 aligned to the pressurizing chamber 62.

The base 56 includes a transparent substrate 68, an opaque layer 70 and a microstructured layer 72, the constitutions of which are substantially identical to those of the transparent substrate 12, an opaque layer 16 and a microstructured layer 18 of the microstructured element 10 shown in FIG. 1. That is, the opaque layer 70 includes a plurality of rectangular opaque strips (not shown) disposed on the major surface of the transparent substrate 68, in a local streaked pattern located away from the heating elements 58. Also, the microstructured layer 72 is formed as a plurality of minute oblique ribs or projections 74, each having a parallelogram vertical section, disposed, in a mutually parallel side-by-side arrangement, on and projecting obliquely from the major surface of the transparent substrate 68.

The microstructured layer 72 in the form of the oblique ribs 74 is located at a position corresponding to the flow-dividing chamber 64 defined in the body 52. Therefore, the oblique ribs 74 formed in the base 56 protrude to be accommodated inside the flow-dividing chamber 64, so as to lean toward the pressurizing chambers 62 and the nozzle plate 60.

In the ink-jet head 50, when the ink held in each pressurizing chamber 62 is pressurized by the excitation of the corresponding heating element 58, the ink is substantially prevented from flowing back to the flow-dividing chamber 64, due to large fluid resistance resulted from the existence of the plural oblique ribs 74 leaning toward the pressurizing chamber 62 in the flow-dividing chamber 64. Consequently, the ink is discharged with a sufficient pressure and discharging energy through the nozzle 66. The increased discharging energy of the ink can make it hard for the discharged ink to be affected by an external force and, therefore, the ink-discharging performance as well as the printing quality of the ink jet printer, in which the ink-jet head 50 is incorporated, can be improved. Moreover, the oblique ribs 74 do not substantially prevent the ink from flowing through the flow-dividing chamber 64 to the respective pressurizing chambers 62, so that the response of the ink discharging operation is maintained at a desired level. Accordingly, the ink-jet head 50 can ensure a high printing quality as well as a quick discharge response, when it is incorporated in an ink jet printer or plotter.

The base 56 of the ink-jet head 50 may be manufactured through the process substantially identical to the manufacturing process of the microstructured element 10 as described with reference to FIGS. 2A to 3D. In this respect, a negative-type thick film resist (THB-130N; JSR Corporation) is also suitably used for a photosensitive layer coated, as a material of the microstructured layer 72, on the transparent substrate 68 and the opaque layer 70, from the viewpoint of durability and stability against ink generally used in the ink jet printer. The heating elements 58 are formed at predetermined positions on the opaque layer 70 before the photosensitive layer is coated. The heating element 58 is a membrane heater preferably made as a metal film of, such as $Ta_2N$, W, NiCr, $TaN_x$, and so on.

Figure 6:
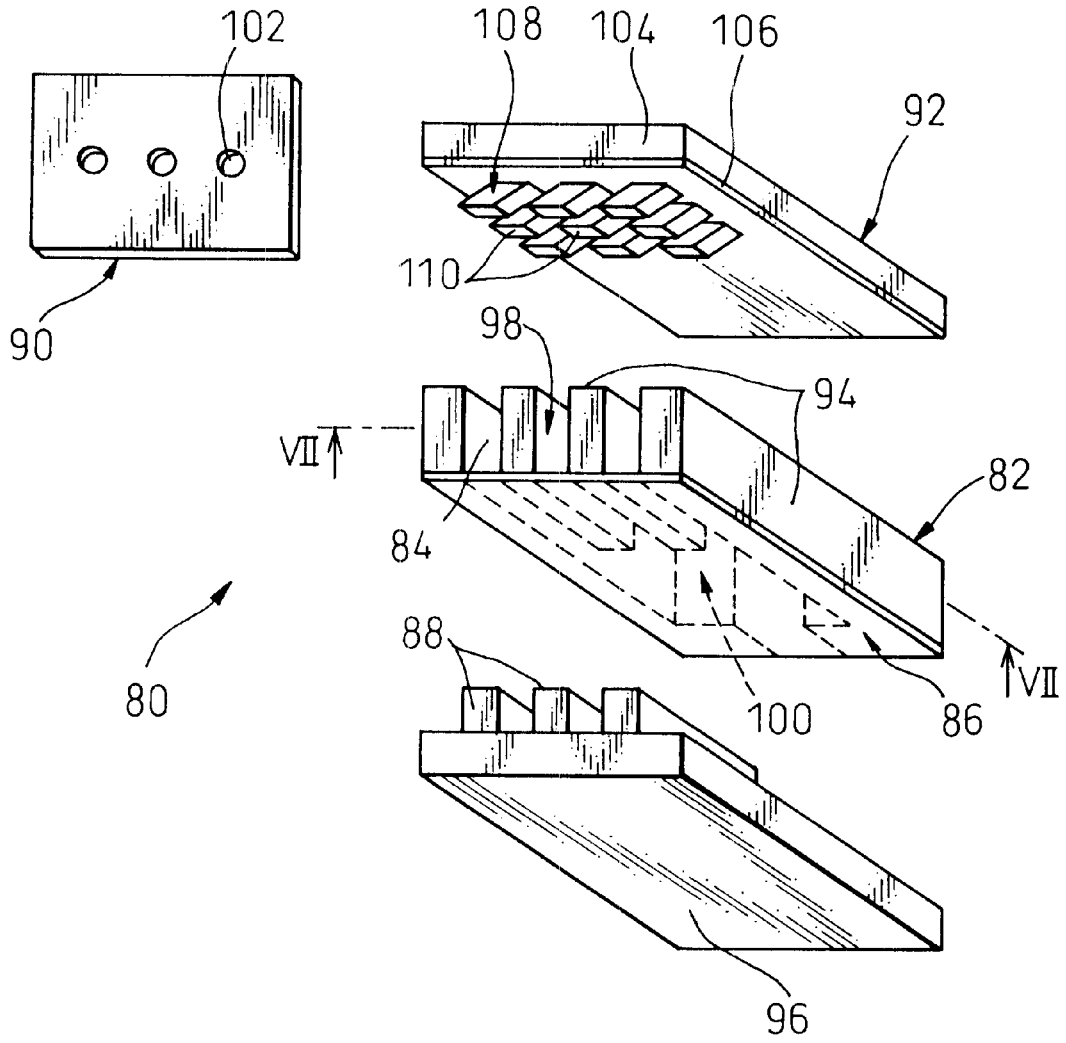
FIG. 6 is an exploded perspective view of an ink-jet head according to further embodiment of the present invention.
Figure 7:
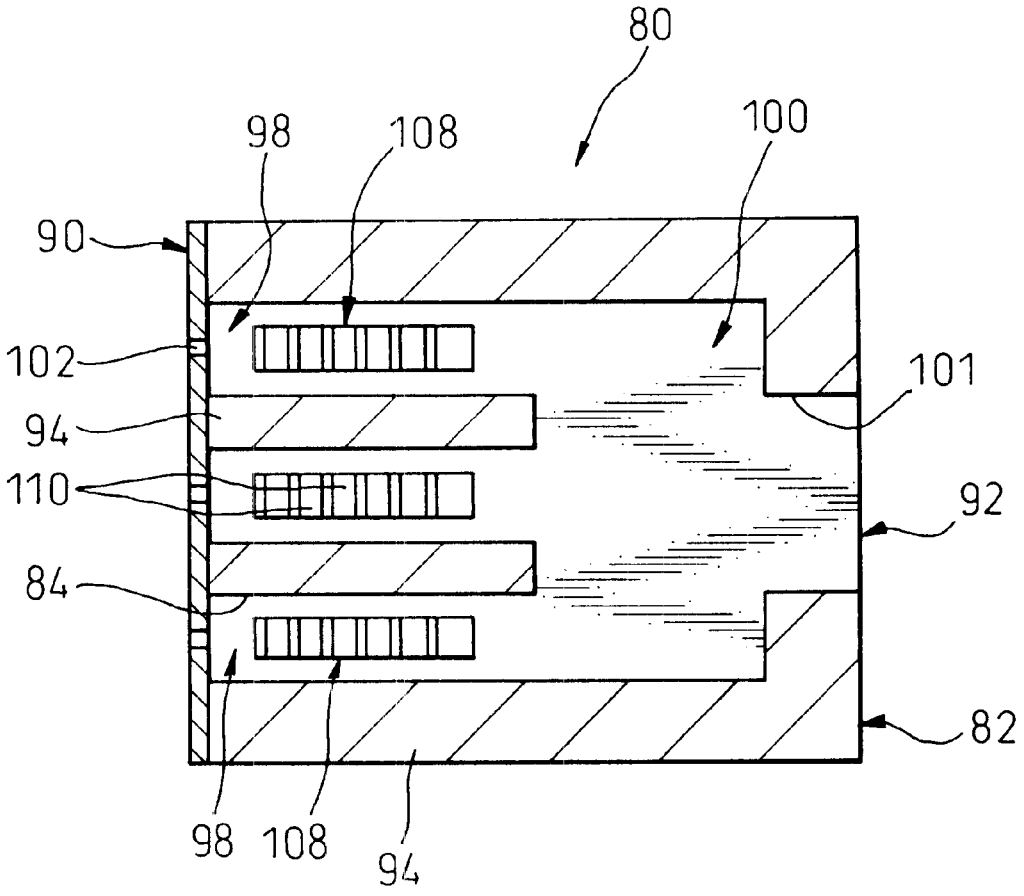
FIG. 7 is a sectional view showing the ink-jet head of FIG. 6, taken along line VII—VII in an assembled state.

FIGS. 6 and 7 show a piezoelectric-type ink-jet head 80 including a microstructured element, according to another embodiment of the present invention and adapted to be incorporated in an ink jet printer or plotter (not shown). The ink-jet head 80 includes a body 82 with a plurality (three, in the drawing) of channels or grooves 84, a diaphragm 86 secured to the body 82 so as to cover the length of the grooves 84, a plurality (three, in the drawing) of piezoelectric elements or actuators 88 arranged on the reverse side of the diaphragm 86 away from the grooves 84, a nozzle plate 90 fixed to the body 82 adjacent to the longitudinal ends of the grooves 84, and a cover plate 92 secured to the body 82 so as to face oppositely to the diaphragm 86 and cover the length of the grooves 84. The body 82, the diaphragm 86, the nozzle plate 90 and the cover plate 92 are structural minute elements for affecting the flow of ink by the shape or dimension of an ink passage defined in these components, and especially, the cover plate 92 comprises a microstructured element, the constitution of which is similar to that of the microstructured element 10 shown in FIG. 1.

In this embodiment, the body 82 is composed of a plurality (four, in the drawing) of wall members 94 integrally connected to the diaphragm 86 in a mutually spaced arrangement thereon, as described later, and the grooves 84 are defined between the wall members 94 and the diaphragm 86. Also, the piezoelectric elements 88 are securely supported on a rigid base plate 96.

The diaphragm 86 is made of a flexible material, and a plurality (three, in the drawing) of pressurizing chambers 98 are defined between the diaphragm 86, the grooves 84 of the body 82, the nozzle plate 90 and the cover plate 92. The pressurizing chambers 98 are connected to a flow-dividing chamber 100 provided in the body 82, and ink supplied from an external ink-source (not shown) flows through the flow-dividing chamber 100 into the respective pressurizing chambers 98. In this embodiment, the flow-dividing chamber 100 is defined between a wider groove, recessed in the body 82 adjacent to the grooves 84, the diaphragm 86 and the cover plate 92. Also, the flow-dividing chamber 100 may be connected through an ink inlet 101 defined in the body 82 with an ink conduit (not shown) extending from the external ink-source.

The nozzle plate 90 is provided with a plurality (three, in the drawing) of nozzles 102, each of which opens to the respective one of the pressurizing chambers 98. Each of the piezoelectric elements 88 is arranged in association with the respective one pressurizing chamber 98 and located at a position corresponding to the latter along the reverse side of the diaphragm 86. It will be appreciated that two or more piezoelectric elements 88 may be provided for respective one pressurizing chamber 98.

Figure 8:
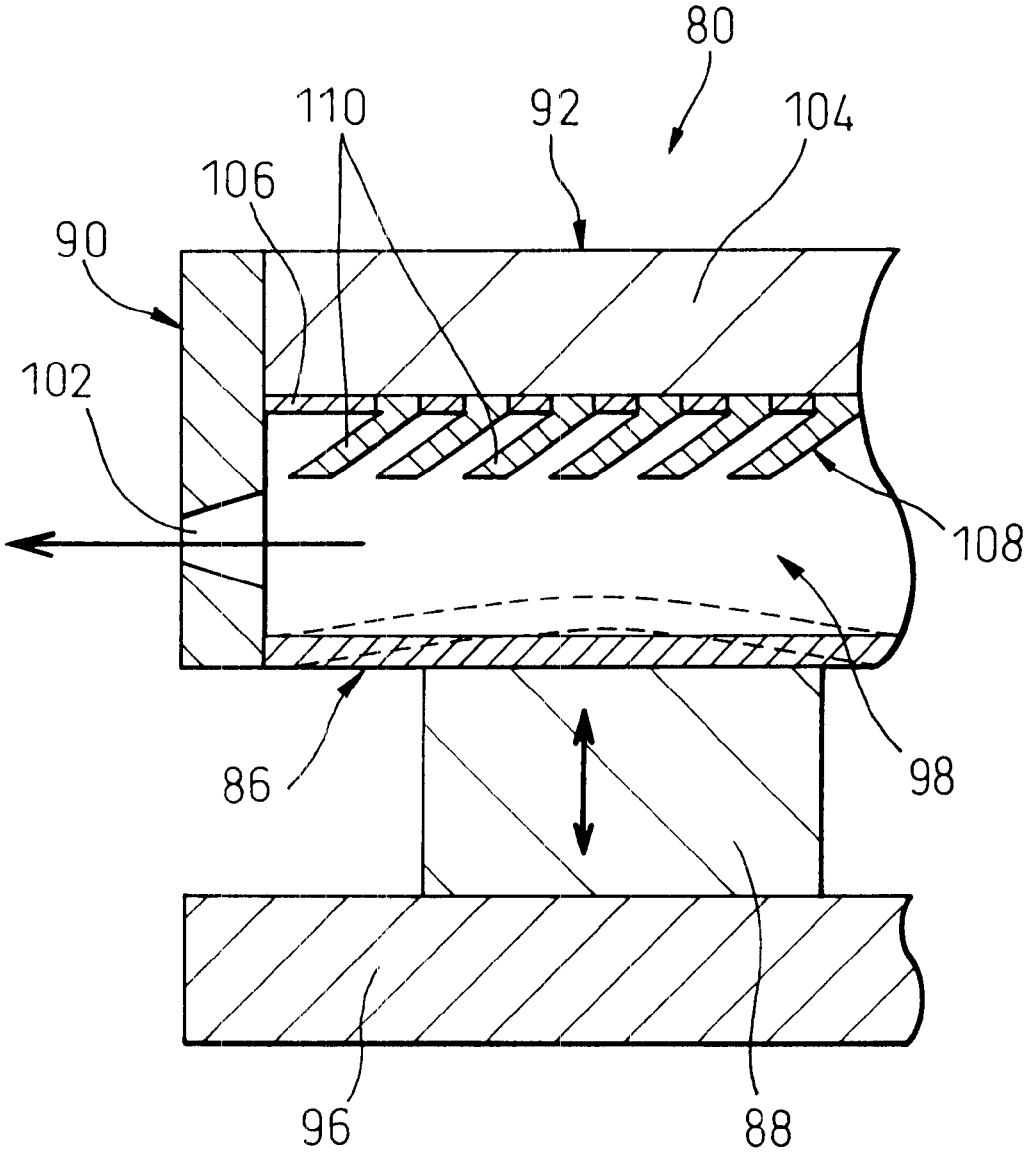
FIG. 8 is a fragmentary vertical section showing a part of the ink-jet head of FIG. 6 to illustrate the discharging operation thereof.

The piezoelectric element 88, supported on the rigid base plate 96, is energized to generate an electrostrictive effect, and thereby actuates or deforms a part of the diaphragm 86 defining the corresponding one of the pressurizing chambers 98 (see FIG. 8). As the part of the diaphragm 86 is deformed to instantaneously reduce the volume of the corresponding pressurizing chamber 98 (as shown by a broken line in FIG. 8), the ink held therein is pressurized and thereby discharged through the nozzle 102 aligned to the pressurizing chamber 98. The piezoelectric elements 88 are separated from each other and are fixedly supported on the rigid base plate 96 that in turn is securely assembled with the body 82, so as to eliminate any influence on the other parts of the diaphragm 86 defining the other pressurizing chambers 98 during an ink pressurizing operation.

The cover plate 92 includes a transparent substrate 104, an opaque layer 106 and a microstructured layer 108, the constitutions of which are similar to those of the transparent substrate 12, an opaque layer 16 and a microstructured layer 18 of the microstructured element 10 shown in FIG. 1. That is, the opaque layer 106 includes a plurality of rectangular opaque strips (not shown) disposed on the major surface of the transparent substrate 104, in a local streaks pattern of separate three arrays transversely spaced from each other. Also, the microstructured layer 108 is formed as a plurality of minute oblique ribs or projections 110, each having a parallelogram vertical section, disposed, in a mutually parallel side-by-side arrangement in each of three arrays, on and projecting obliquely from the major surface of the transparent substrate 104.

Each of three arrays of the plural oblique ribs 110, constituting the microstructured layer 108, is located at a position corresponding to respective one of the pressurizing chambers 98 defined in the body 82. Therefore, the oblique ribs 110 in each array formed in the cover plate 92 protrude to be accommodated inside each pressurizing chamber 98, so as to lean toward the nozzle plate 90. In this arrangement, the oblique angle of each rib 110 is preferably selected in the range of 30 to 60 degrees, e.g., 45 degrees.

In the ink-jet head 80, when the ink held in each pressurizing chamber 98 is pressurized by the energization of the corresponding piezoelectric element 88, the ink is substantially prevented from flowing back to the flow-dividing chamber 100, due to large fluid resistance resulted from the existence of the plural oblique ribs 110 leaning toward the nozzle plate 90 in the pressurizing chamber 98 (see FIG. 8). Consequently, the ink is discharged with a sufficient pressure and discharging energy through the nozzle 102. The increased discharging energy of the ink can make it hard for the discharged ink to be affected by an external force and, therefore, the ink-discharging performance as well as the printing quality of the ink jet printer, in which the ink-jet head 80 is incorporated, can be improved. Moreover, the oblique ribs 110 do not substantially hinder the ink from flowing through the flow-dividing chamber 100 to the respective pressurizing chambers 98, so that the response of the ink discharging operation is maintained at a desired level. Accordingly, the ink-jet head 80 can ensure high printing quality as well as a quick discharge response, when it is incorporated in an ink jet printer or plotter.

As will be understood from the above, the ink-jet head 80 can eliminate the provision of any restrictions or orifices, for hindering the back flow of ink, between the pressurizing chambers 98 and the flow-dividing chamber 100. However, it is also possible to provide such restrictions or orifices, in addition to the provision of the oblique ribs 110. In this arrangement, it is possible to control the printing quality and the discharge response of the ink-jet head 80, by suitably selecting the shapes and dimensions of the orifices.

The cover plate 92 of the ink-jet head 80 may be manufactured through the process substantially identical to the manufacturing process of the microstructured element 10 as described with reference to FIGS. 2A to 3D. In this respect, a negative-type thick film resist (THB-130N; JSR Corporation) is also suitably used for a photosensitive layer coated, as a material of the microstructured layer 108, on the transparent substrate 104 and the opaque layer 106, from the viewpoint of durability and stability against ink generally used in the ink jet printer.

Certain examples of the constitution or configuration of the ink-jet head 80 and of the material usable for carrying out the manufacturing process of the ink-jet head 80 are as follows. Concerning the cover plate 92, the transparent substrate 104 is made of a 0.4 mm thick borosilicate glass pane. The opaque layer 106 is made of a 0.2 $\mu$m thick chromium (Cr) film, which is deposited on the transparent substrate 104 and patterned through a conventional lithography technique into the plural opaque strips with 100 $\mu$m spaces therebetween.

In the deposition process, the Cr film is spattered under the condition of a radio-frequency power of 450 W, an argon (Ar) gas pressure of 1.0 Pa, and a deposition time of 5 minutes. In the lithography process, a positive-type resist (trade name AZ-4330; available from Hoechst Japan Limited, Tokyo) is coated on the Cr film to a thickness of 3 $\mu$m through a spin-coat technique, and is partially exposed through a mask at an exposure value of 100 mJ/cm$^2$. The positive-type resist is then developed by using a developer suitable for AZ-4330 (trade name AZ-400K; available from Hoechst Japan Limited, Tokyo) for 2 minutes. The portion of the Cr film not covered by the resist is etched by a nitrate-based etchant to pattern the Cr film. The positive-type resist is finally removed by aceton.

A photosensitive layer used for forming the microstructured layer 108 is made of a negative-type thick film resist (trade name THB-130N; available from JSR Corporation, Tokyo), and is coated on the transparent substrate 104 and the opaque layer 106 to a thickness of 50 $\mu$m through a spin-coat technique wherein a single coating process at a rotation speed of 1000 rpm for 10 seconds is performed. The photosensitive layer is exposed to ultraviolet transmitted through the transparent substrate 104 from the back'surface thereof at an oblique exposing angle of 45 degrees, at an exposure value of 600 mJ/cm$^2$. The photosensitive layer is then developed by using a developer suitable for THB-130N (trade name THB-D1; available from JSR Corporation, Tokyo) at a, temperature of 40° C. for 5 minutes through a spraying process. In this manner, ten oblique ribs 110 in one array, each having a height of 50 $\mu$m, a horizontal thickness of 50 m and a 45 degree oblique angle, are formed as the microstructured layer 108, while defining 100 $\mu$m horizontal spaces between the adjacent ribs 110 in each array.

Figure 9:
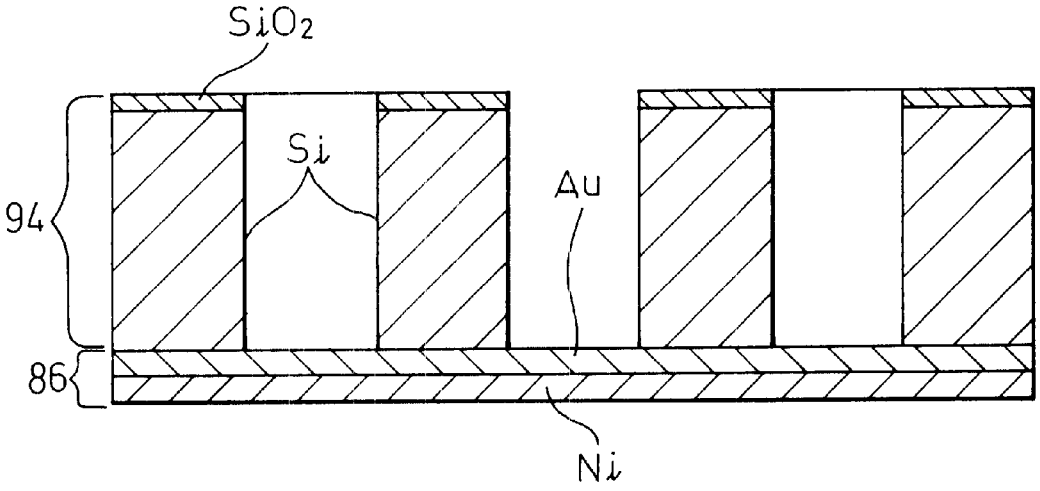
FIG. 9 is a fragmentary vertical section showing a detail of components of the ink-jet head of FIG. 6.

The wall members 94 of the body 82 may be integrally formed with the diaphragm 86 through an etching process as follows. As shown in FIG. 9, a substrate made of silicon (Si) is provided, non-conductive overcoats made of silica ($SiO_2$) are formed in a desired pattern on one side of the Si substrate, a conductive coat made of gold (Au) is formed on another side of the Si substrate, and a plated film made of nickel (Ni) is formed on the outer face of Au coat. The Si substrate is then etched, and thereby the wall members 94 are formed. Through these steps, the diaphragm 86 made of the lamination of Ni film and Au coat is fixedly and integrally connected with the wall members 94 each being made of Si substrate and $SiO_2$ overcoat, without using any bonding means such as adhesives. In the preferred embodiment, each wall member 94 thus formed has a height of 301 $\mu$m, and the diaphragm 86 is composed of a 0.2 $\mu$m thick Au coat and a 5 $\mu$m thick Ni film.

The diaphragm 86 having the above laminated structure has appropriate flexibility for ensuring the high printing quality as well as the quick discharge response of the ink-jet head 80. Also, both Au coat and Ni film have sufficient durability against aqueous solution of potassium hydroxide (KOH), which may be used in certain additional treatments.

The other components of the ink-jet head 80, i.e., the piezoelectric elements 88, the nozzle plate 90 and the base plate 96, may be produced through conventional machining or molding processes. All the components thus produced may be bonded to each other by using adhesives.

It should be noted that the ink-jet head according to the present invention is characterized by the provision of plural oblique ribs or projections arranged to protrude in an ink passage defined in a body so as to lean toward an ink-discharging nozzle, for substantially hindering the back flow of ink from the pressurizing chamber to the flow-dividing chamber, while allowing the smooth supply of ink to the pressurizing chamber. From this viewpoint, it is possible to produce the microstructured element used in the ink-jet head, such as the base 56 or the cover plate 92, through any other conventional processes, such as machining or molding, to form the plural oblique ribs, in the case where the structural accuracy of the ribs may somewhat be disregarded. Also, the oblique ribs may be formed on the wall members 94 of the body 82 to protrude in the pressurizing chambers 98.

Figure 10:
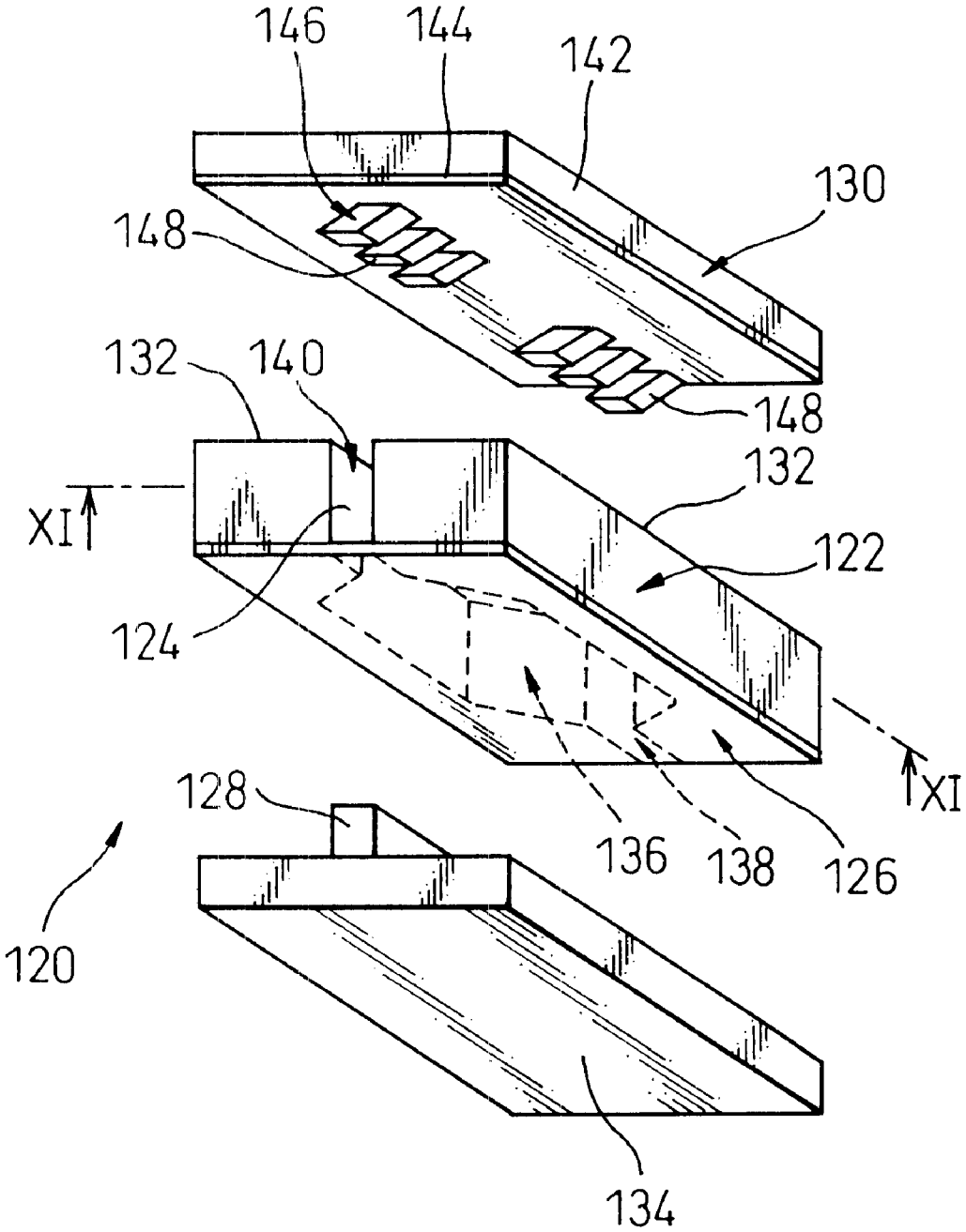
FIG. 10 is an exploded perspective view of a miniaturized pump unit according to yet further embodiment of the present invention.
Figure 11:
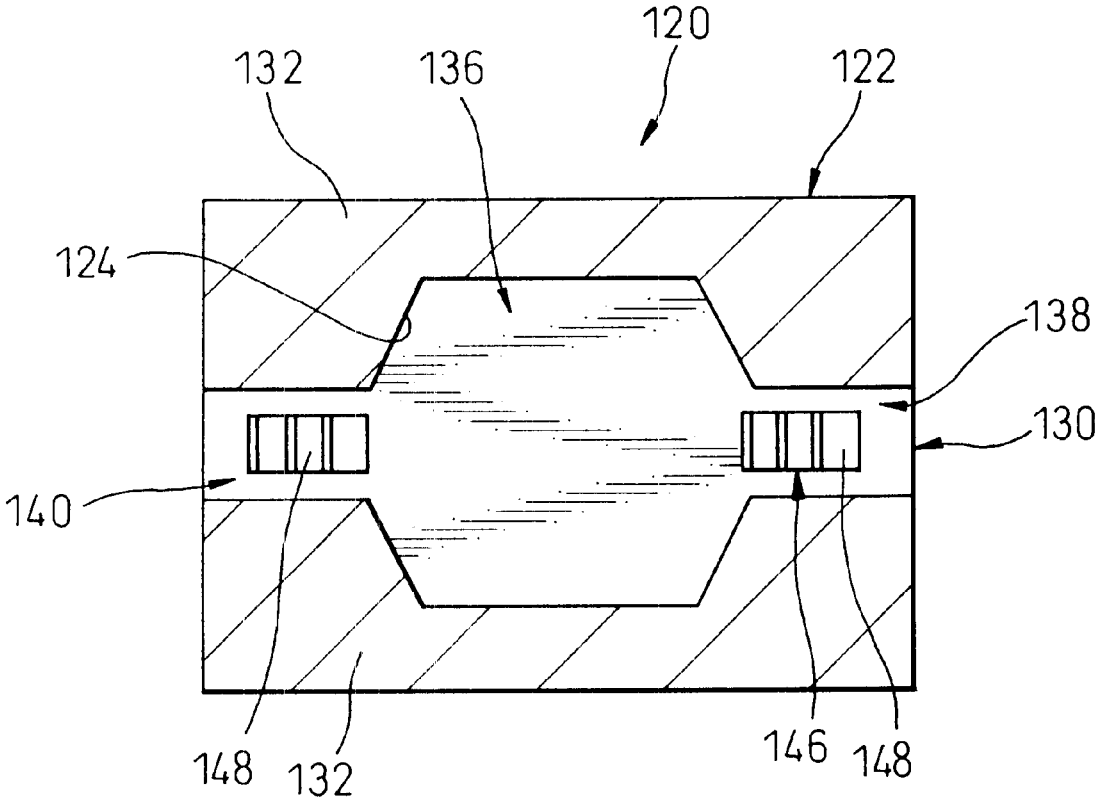
FIG. 11 is a sectional view showing the miniaturized pump unit of FIG. 10, taken along line XI—XI in an assembled state.

FIGS. 10 and 11 show a valveless- or piezoelectric-type miniaturized pump unit 120 including a microstructured element, according to further embodiment of the present invention. The miniaturized pump unit 120 can ensure a high precision control of a fluid flow rate, and be used for, e.g., chemical-analysis or medical purposes. The miniaturized pump unit 120 includes a body 122 with a fluid-passage or channel 124, a diaphragm 126 secured to the body 122 so as to cover the length of the channel 124, a piezoelectric element or actuator 128 arranged on the reverse side of the diaphragm 126 away from the channel 124, and a cover plate 130 secured to the body 122 so as to face opposite to the diaphragm 126 and cover the length of the channel 124. The body 122, the diaphragm 126 and the cover plate 130 are structural minute elements for affecting the flow of fluid by the shape or dimension of a fluid passage defined in these components, and especially, the cover plate 130 comprises a microstructured element, the constitution of which is similar to that of the microstructured element 10 shown in FIG. 1.

In this embodiment, the body 122 is composed of a plurality (two, in the drawing) of wall members 132 integrally connected to the diaphragm 126 in a mutually spaced arrangement thereon, as described later, and the channel 124 is defined between the wall members 132 and the diaphragm 126. Also, the piezoelectric element 128 is securely supported on a rigid base plate 134.

The channel 124 of the body 122 includes a single expanded area located at the generally center of the channel 124 and a pair of restricted areas at the opposed open ends of the channel 124. The diaphragm 126 is made of a flexible material, and a single pressure chamber 136 is defined between the diaphragm 126 and the expanded area of the channel 124 of the body 122. The pressure chamber 136 is connected to an inlet port 138 and an outlet port 140, which are defined between the diaphragm 126 and the respective restricted areas of the channel 124. The channel 124 is connected through the inlet and outlet ports 138, 140 with an external fluid circuit. The piezoelectric element 128 is arranged in association with the pressure chamber 136 and located at a position corresponding to the latter along the reverse side of the diaphragm 126. It will be appreciated that two or more piezoelectric elements 128 may be provided for the pressure chamber 136.

Figure 12:
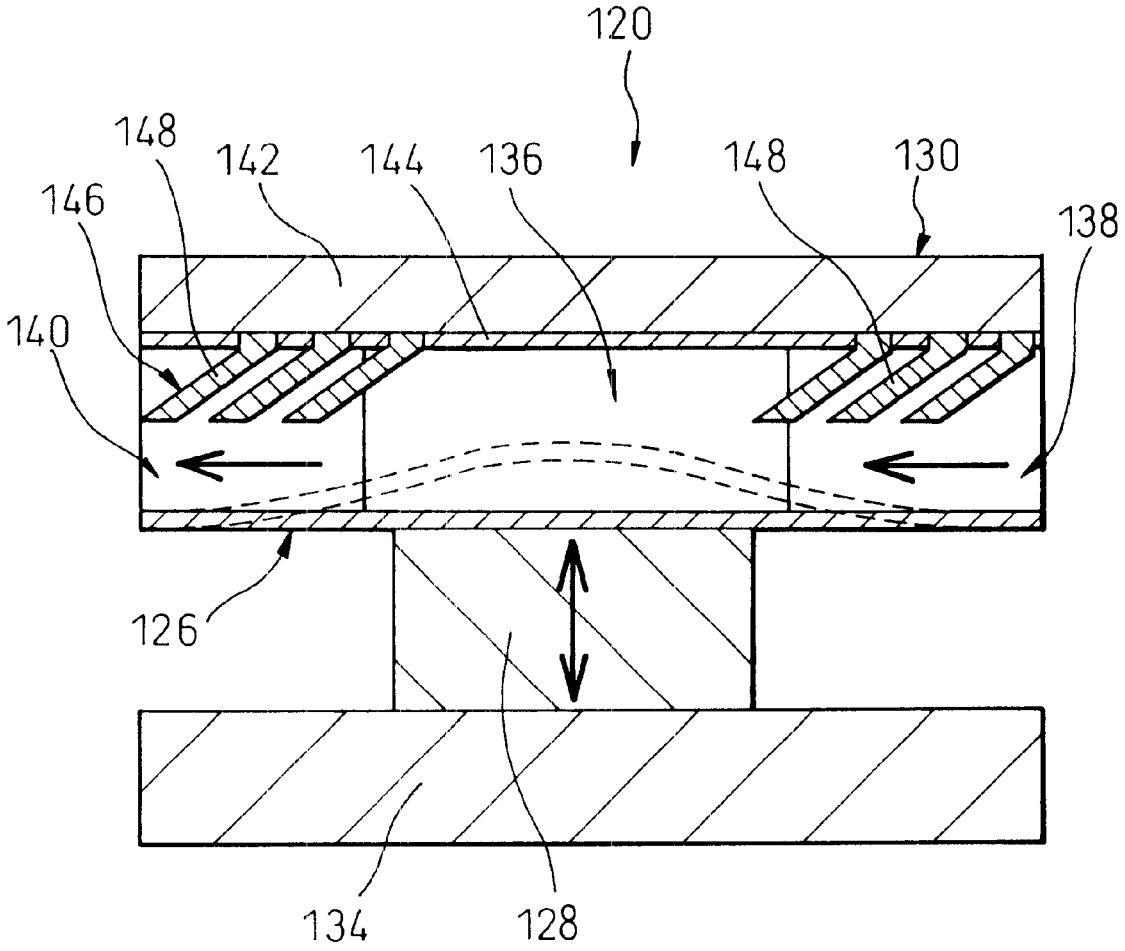
FIG. 12 is a fragmentary vertical section showing a part of the miniaturized pump unit of FIG. 10 to illustrate the pumping operation thereof.

The piezoelectric element 128, supported on the rigid base plate 134, is excited to generate an electrostrictive effect, and thereby actuates or deforms a part of the diaphragm 126 defining the pressure chamber 136 (see FIG. 12). As the part of the diaphragm 126 is deformed to instantaneously reduce the volume of the. pressure chamber 136 (as shown by a broken line in FIG. 12), the fluid therein is pressurized and thereby discharged from the pressure chamber 136.

The cover plate 130 includes a transparent substrate 142, an opaque layer 144 and a microstructured layer 146, the constitutions of which are similar to those of the transparent substrate 12, an opaque layer 16 and a microstructured layer 18 of the microstructured element 10 shown in FIG. 1. That is, the opaque layer 144 includes a plurality of rectangular opaque strips (not shown) disposed on the major surface of the transparent substrate 142, in a local streaked pattern of two separate arrays longitudinally spaced from each other. Also, the microstructured layer 146 is formed as a plurality of minute oblique ribs or projections 148, each having a parallelogram vertical section, disposed, in a mutually parallel side-by-side arrangement in each of two arrays, on and projecting obliquely from the major surface of the transparent substrate 142.

Each of two arrays of the plural oblique ribs 148, constituting the microstructured layer 146, is located at a position corresponding to respective one of the inlet and outlet ports 138, 140 defined in the body 122. Therefore, the oblique ribs 148 in the first array formed in the cover plate 130 protrude to be accommodated inside the inlet port 138, so as to lean toward the pressure chamber 136. Also, the oblique ribs 148 in the second array formed in the cover plate 130 protrude to be accommodated inside the outlet port 140, so as to lean toward the open end of the outlet port 140. In this arrangement, the oblique angle of each rib 148 is preferably selected in the range of 30 to 60 degrees, e.g., 45 degrees.

In the miniaturized pump unit 120, when the fluid held in the pressure chamber 136 is pressurized by the excitation of the piezoelectric element 128, the fluid is substantially prevented from flowing toward the inlet port 138, due to large fluid resistance resulted from the existence of the plural oblique ribs 148 leaning toward the pressure chamber 136 in the inlet port 138, and simultaneously, is allowed to flow toward the outlet port 140, due to the relatively low fluid resistance of the oblique ribs 148 leaning toward the open end in the outlet port 140 (see FIG. 12). Moreover, the oblique ribs 148 do not substantially hinder the fluid flow in the channel 124 in a direction from the inlet port 138 toward the outlet port 140 but substantially hinder the fluid flow in a direction reverse thereto. Consequently, as the part of the diaphragm is sequentially deformed to repeat the decrease and subsequent increase of the volume of the pressure chamber 136 by repeating the excitation of the piezoelectric element 128, the fluid in the external fluid circuit is pumped through the channel 124 in the body 122, in a direction from the inlet port 138 through the pressure chamber 136 to the outlet port 140, on the assumption that the internal pressure of the fluid circuit connected to the channel 124 is balanced between the inlet port side and the outlet port side.

As will be understood from the above, in the miniaturized pump unit 120, it is possible to reduce the numbers of pressure chamber 136 and the piezoelectric element 128, without deteriorating the pumping performance. Accordingly, the miniaturized pump unit 120 can be easily and properly operated with a relatively simple structure, and can facilitate the reduction of dimension and manufacturing cost to a required level. The miniaturized pump unit 120 having above structure can ensure a high precision control of a fluid flow rate, and thus can be advantageously used, e.g., for delivering very slight amount of materials, such as medicaments or gases, in a mixing apparatus, or for precisely adjusting the amount of reagent in a chemical analyzing apparatus.

The cover plate 130 of the miniaturized pump unit 120 may be manufactured through the process substantially identical to the manufacturing process of the microstructured element 10 as described with reference to FIGS. 2A to 3D. In this manufacturing process, the number of oblique ribs 148 arranged in the respective inlet and outlet ports 138, 140 can be easily and suitably selected, in accordance with the required performance of the pump unit 120.

Certain examples of the constitution or configuration of the miniaturized pump unit 120 and of the material usable for carrying out the manufacturing process of the miniaturized pump unit 120 are as follows. Concerning the cover plate 130, the transparent substrate 142 is made of a 0.4 mm thick borosilicate glass pane. The opaque layer 144 is made of a 0.2 $\mu$m thick chromium (Cr) film, which is deposited on the transparent substrate 142 and patterned through a conventional lithography technique into the plural opaque strips with 100 $\mu$m spaces therebetween.

In the deposition process, the Cr film is spattered under the condition of the radio-frequency power of 450 w, the argon (Ar) gas pressure of 1.0 Pa, and the deposition time of 5 minutes. In the lithography process, a positive-type resist (trade name AZ-4330; available from Hoechst Japan Limited, Tokyo) is coated on the Cr film to a thickness of 3 $\mu$m through a spin-coat technique, and is partially exposed through a mask at an exposure value of 100 mJ/cm$^2$. The positive-type resist is then developed by using a developer suitable for AZ-4330 (a trade name of AZ-400K; available from Hoechst Japan Limited, in Tokyo) for 2 minutes. The portion of the Cr film not covered by the resist is etched by a nitrate-based etchant to pattern the Cr film. The positive-type resist is finally removed by aceton.

A photosensitive layer used for forming the microstructured layer 146 is made of a negative-type thick film resist (trade name THB-130N; available from JSR Corporation, Tokyo), and is coated on the transparent substrate 142 and the opaque layer 144 to a thickness of 50 $\mu$m through a spin-coat technique wherein a single coating process at a rotation speed of 1000 rpm for 10 seconds is performed. The photosensitive layer is exposed to ultraviolet transmitted through the transparent substrate 142 from the back surface thereof at an oblique exposing angle of 45 degrees, at an exposure value of 600 mJ/cm$^2$. The photosensitive layer is then developed by using a developer suitable for THB-130N (trade name THB-D1; available from JSR Corporation, Tokyo) at a temperature of 40° C. for 5 minutes through a spraying process. In this manner, ten oblique ribs 148, in one array, each having a height of 50 $\mu$m, a horizontal thickness of 50 $\mu$m and a 45 degree oblique angle, are formed: as the microstructured layer 146, while defining 100 $\mu$m: horizontal spaces between the adjacent ribs 148 in each array.

Figure 13:
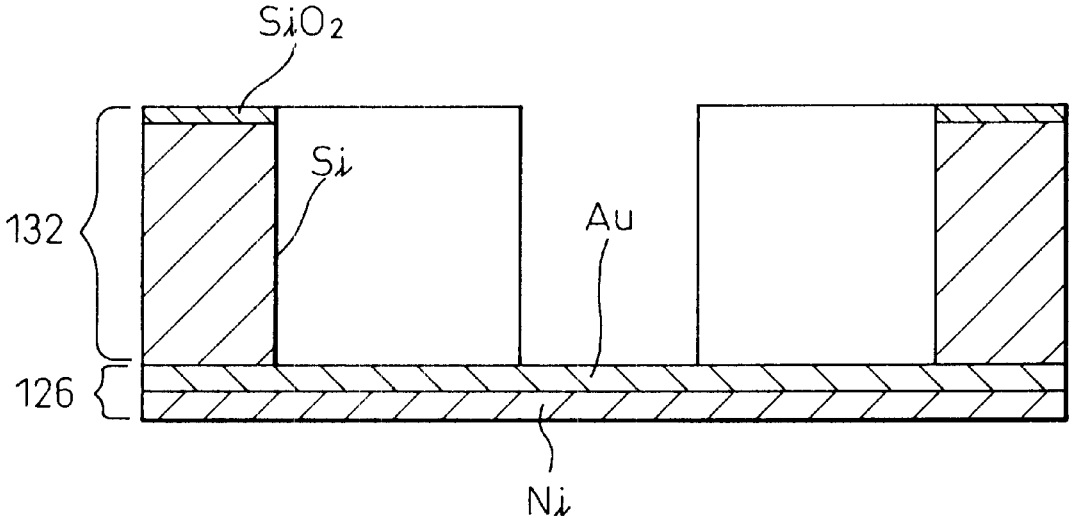
FIG. 13 is a fragmentary vertical section showing a detail of components of the miniaturized pump unit of FIG. 6.

The wall members 132 of the body 122 may be integrally formed with the diaphragm 126 through an etching process as follows. As shown in FIG. 13, a substrate made of silicon (Si) is provided, non-conductive overcoats made of silica ($SiO_2$) are formed in a desired pattern on one side of the Si substrate, a conductive coat made of gold (Au) is formed on another side of the Si substrate, and a plated film made of nickel (Ni) is formed on the outer face of Au coat. The Si substrate is then etched, and thereby the wall members 132 are formed. Through these steps, the diaphragm 126 made of the lamination of Ni film and Au coat is fixedly and integrally connected with the wall members 132 each being made of Si substrate and $SiO_2$ overcoat, without using any bonding means such as adhesives. In the preferred embodiment, each wall member 132 thus formed has a height of 301 $\mu$m, and the diaphragm 126 is composed of a 0.2 $\mu$m thick Au coat and a 5 $\mu$m thick Ni film.

The diaphragm 126 having the above laminated structure has appropriate flexibility for ensuring a good pumping performance of the miniaturized pump unit 120. Also, both Au coat and Ni film have sufficient durability against aqueous solution of potassium hydroxide (KOH), which may be used in certain additional treatments.

The other components of the miniaturized pump unit 120, i.e., the piezoelectric elements 128 and the base plate 134, may be produced through conventional machining or molding processes. All the components thus produced may be bonded to each other by using adhesives.

It should be noted that the miniaturized pump unit according to the present invention is characterized by the provision of plural oblique ribs or projections arranged to protrude in fluid inlet and outlet ports defined in a body so as to lean toward the open end of the outlet port, for substantially hindering the flow of fluid from the pressure chamber to the inlet port, while allowing the smooth flow of fluid from the pressure chamber to the outlet port. From this viewpoint, it is possible to produce the cover plate 130 through other conventional processes, such as machining or molding, to form the plural oblique ribs, in the case where the structural accuracy of the ribs may be somewhat disregarded. Also, the oblique ribs may be formed on the wall members 132 of the body 122 to protrude into the inlet and outlet ports 138, 140.

Figure 14:
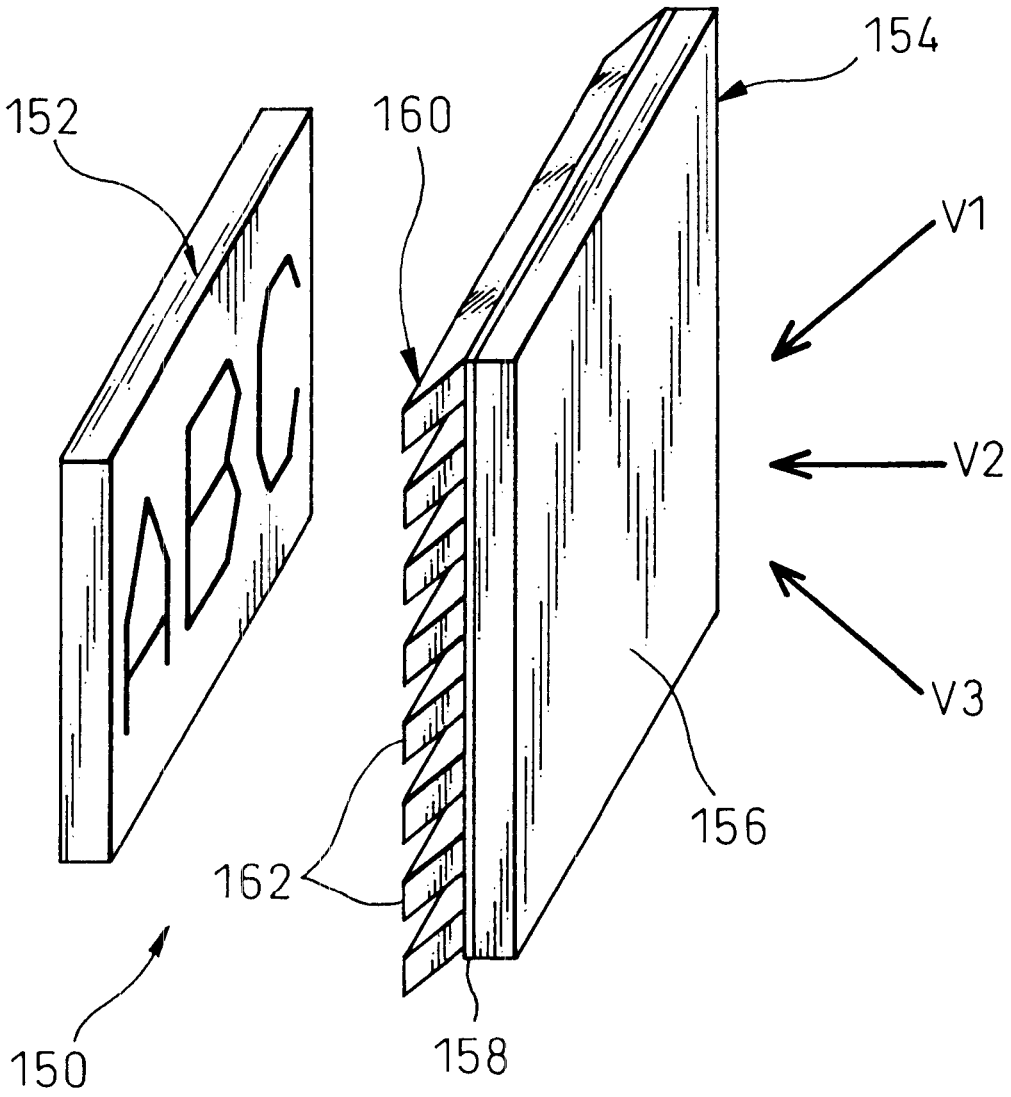
FIG. 14 is an exploded perspective view of a display system according to yet another embodiment of the present invention.

FIG. 14 shows a display system 150 including a microstructured element, according to yet further embodiment of the present invention. The display system 150 includes a display unit 152, such as a liquid crystal display, and a unidirectional transmittable cover plate 154 arranged in front of and parallel to the screen of the display unit 152. The unidirectional transmittable cover plate 154 is a structural minute element for affecting the transmission of light emitted from the screen of the display unit 152, and comprises a microstructured element, the constitution of which is similar to that of the microstructured element 10 shown in FIG. 1.

The unidirectional transmittable cover plate 154 includes a transparent substrate 156 and an opaque layer 158, the constitutions of which are substantially identical to those of the transparent substrate 12 and an opaque layer 16 of the microstructured element 10 shown in FIG. 1. That is, the opaque layer 158 includes a plurality of rectangular opaque strips (not shown) disposed on the major surface of the transparent substrate 156 in a local streaked pattern. The unidirectional transmittable cover plate 154 also includes a microstructured layer 160 formed as a plurality of minute oblique ribs or projections 162, each having a parallelogram vertical section, disposed, in a mutually parallel side-by-side arrangement, above and projecting obliquely from the major surface of the transparent substrate 156. The microstructured layer 160 is somewhat different from the microstructured layer 18 of the microstructured element 10 shown in FIG. 1.

The plural oblique ribs 162, constituting the microstructured layer 160, are located to face the screen of the display unit 152, so as to act as shading elements. The oblique angle of each rib 162 with the major surface of the transparent substrate 156 is preferably selected in the range of 30 to 60 degrees, e.g., 50 degrees. In this arrangement, the screen of the display unit 152 is visible through the unidirectional transmittable cover plate 154 only in a direction generally parallel to the oblique ribs 162, i.e., through the gaps between the adjacent oblique ribs 162, as shown by an arrow V1 in FIG. 14. On the other hand, the screen is not visible through the unidirectional transmittable cover plate 154 in any other direction, such as shown by an arrow V2 or V3.

Consequently, the display system 150 can possess a unidirectional visibility of the screen of the display unit 152. In the case where the display system 150 is applied to a display panel of a watch or clock, a decorative appearance of the display panel may be afforded by using a decorative material for the microstructured layer 160 of the unidirectional transmittable cover plate 154, while maintaining the visibility of the display panel as unidirectional.

Figure 15A:
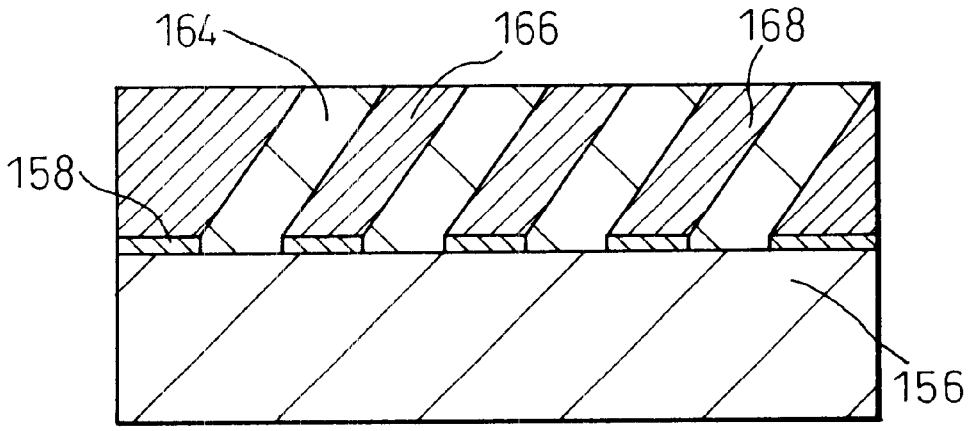
FIGS. 15A and 15B illustrate the steps of manufacturing of the component of the display system shown in FIG. 14.
Figure 15B:
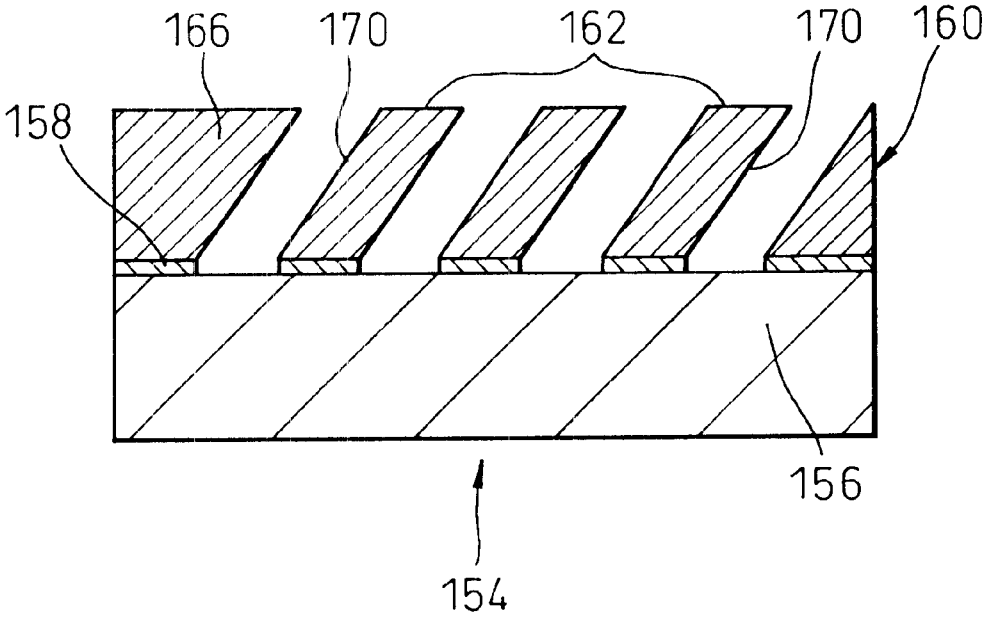

The unidirectional transmittable cover plate 154 of the display system 150 may partially be manufactured through the process substantially identical to the manufacturing process of the microstructured element 10 as described with reference to FIGS. 2A to 3D. Thereafter, the unidirectional transmittable cover plate 154 is completed through an additional process as shown in FIGS. 15A and 15B. That is, after the photosensitive-layer developing step (see FIG. 2C), a photosensitive horizontal spaces between the adjacent ribs 164.

Then, an electroplating of nickel is performed on the Ni opaque layer 158, in the condition of current density of 1 $A/dm^2$ for ten hours, to fill the recesses 168 between adjacent ribs 164. The composition of a plating bath is as follows:

| | |
|---|---|
| Pure water | 5 L |
| Nickel sulfamate | 1650 g |
| Nickel chloride | 150 g |
| Boric acid | 225 g |
| Lauryl sodium sulfate | 5 g |

The ribs 164 are removed by a suitable release agent, whereby the plural oblique ribs 162 made of nickel are formed, each having a height of 100 $\mu$m, a horizontal thickness of 40 $\mu$m and a 50 degree oblique angle. The unidirectional transmittable cover plate 154 thus formed possesses a decorative appearance due to the silver color of the Ni microstructured layer 160 when viewing from, e.g., an arrow V2 or V3 in FIG. 14.

While the invention has been particularly shown and described with reference to preferred embodiments thereof, it will be understood by those skilled in the art that various changes and modifications may be made without departing from the spirit and scope of the following claims. layer, in the form of plural oblique ribs 164, and the opaque layer 158 are plated with a plating metal 166 to fill a plurality of recesses 168 defined between adjacent ribs 164 (FIG. 15A). Then, the ribs 164 are removed by a suitable release agent, while keeping the plating metal 166 laying above the major surface of the transparent substrate 156 and secured directly on the opaque layer 158 (FIG. 15B). As a result, the plural oblique ribs 162, constituting the microstructured layer 160 and made of the plating metal 166, are formed. The oblique ribs 162 thus formed are respectively provided with slanted lateral faces 170 extending in parallel to each other, and the oblique angles of the lateral faces 170 of the plated oblique ribs 162 are identical to the respective oblique angles $\theta,\theta'$ (FIG. 1) of the lateral faces of the photosensitive oblique ribs 164.

Certain examples of the constitution or configuration of the unidirectional transmittable cover plate 154 and of the material usable for carrying out the manufacturing process of the unidirectional transmittable cover plate 154 are as follows. The transparent substrate 156 is made of a 0.4 mm thick glass pane. The opaque layer 158 is made of a 0.1 $\mu$m thick nickel (Ni) film, which is deposited on the transparent substrate 156 and patterned through a conventional lithography technique into the plural opaque strips with 40 $\mu$m spaces therebetween. The photosensitive layer for forming the oblique ribs 164 is made of a negative-type thick film resist (trade name THB-130N; available from JSR Corporation, Tokyo). In the exposing step of the photosensitive layer, light is transmitted through the transparent substrate 156 from the back surface thereof at the oblique exposing angle of 50 degrees. As a result, after the developing step, the oblique ribs 164, each having 50 degrees oblique angle, are formed on the transparent substrate 156, while defining 40 $\mu$m

What is claimed is:

1. A microstructured element comprising:

a transparent substrate having a major surface;

an opaque layer formed in a certain pattern on said major surface of said transparent substrate; and a microstructured layer formed on or above said major surface of said transparent substrate in a pattern corresponding to said certain pattern of said opaque layer, said microstructured layer including a slanted lateral face extending along an edge of said opaque layer in a direction intersecting said major surface at an oblique angle.

2. A microstructured element as set forth in claim 1, wherein said microstructured layer is made of a photosensitive material.

3. A microstructured element as set forth in claim 1, wherein said microstructured layer is formed directly on said major surface of said transparent substrate.

4. A microstructured element as set forth in claim 1, wherein said microstructured layer is formed directly on said opaque layer.

5. A microstructured element as set forth in claim 1, wherein said opaque layer comprises a plurality of opaque strips, and wherein said microstructured layer comprises a plurality of oblique ribs projecting obliquely from said transparent substrate.

6. An ink-jet head comprising:

a body;

an ink passage defined in said body, said ink passage including a pressurizing chamber for holding ink;

an actuator arranged in association with said pressurizing chamber, said actuator capable of being energized to pressurize the ink held in said pressurizing chamber;

a nozzle opening to said pressurizing chamber; and an oblique rib protruding inside said ink passage to lean toward said nozzle.

7. An ink-jet head as set forth in claim 6, further comprising a microstructured element assembled with said body, said microstructured element including a transparent substrate having a major surface; an opaque layer formed in a certain pattern on said major surface of said transparent substrate; and a microstructured layer formed on or above said major surface of said transparent substrate in a pattern corresponding to said certain pattern of said opaque layer, said microstructured layer including a slanted lateral face extending along an edge of said opaque layer in a direction intersecting said major surface at an oblique angle; and wherein said microstructured layer comprises said oblique rib projecting obliquely from said transparent substrate.

8. An ink-jet head as set forth in claim 6, wherein said oblique rib protrudes inside said pressurizing chamber.

9. An ink-jet head as set forth in claim 6, wherein said ink passage includes a plurality of pressurizing chambers and a flow-dividing chamber connected to said pressurizing chambers, and wherein said oblique rib protrudes inside said flow-dividing chamber.

10. An ink-jet head as set forth in claim 6, wherein a plurality of oblique ribs are disposed in a mutually parallel side-by-side arrangement in said ink passage.

11. A miniaturized pump unit comprising:

a body;

a fluid passage defined in said body, said fluid passage including a pressure chamber and inlet and outlet ports connected to said pressure chamber;

an actuator arranged in association with said pressure chamber, said actuator capable of being energized to pressurize the fluid in said pressure chamber;

a first oblique rib protruding inside said inlet port to lean toward said pressure chamber; and a second oblique rib protruding inside said outlet port to lean toward an open end of said outlet port.

12. A miniaturized pump unit as set forth in claim 11, further comprising a microstructured element. assembled with said body, said microstructured element including a transparent substrate having a major surface; an opaque layer formed in a certain pattern on said major surface of said transparent substrate; and a microstructured layer formed on or above said major surface of said transparent substrate in a pattern corresponding to said certain pattern of said opaque layer, said microstructured layer including a slanted lateral face extending along an edge of said opaque layer in a direction intersecting said major surface at an oblique angle; and wherein said microstructured layer comprises said first and second oblique ribs projecting obliquely from said transparent substrate.

13. A miniaturized pump unit as set forth in claim 11, wherein a plurality of first oblique ribs are dispose d in a mutually parallel side-by-side arrangement in said inlet port, and wherein a plurality of second oblique ribs are disposed in a mutually parallel side-by-side arrangement in said outlet port.

* * * * *